United States Patent [19]

Pierpoline

[11] 4,165,616

[45] Aug. 28, 1979

[54] APPARATUS AND METHOD FOR RESTRICTING TURBINE EXHAUST VELOCITY WITHIN A PREDETERMINED RANGE

[75] Inventor: Mario F. Pierpoline, Media, Pa.

[73] Assignee: Westinghouse Electric Corp., Pittsburgh, Pa.

[21] Appl. No.: 870,897

[22] Filed: Jan. 19, 1978

[51] Int. Cl.[2] ..... F01K 9/00

[52] U.S. Cl. ..... 60/686; 60/661

[58] Field of Search ..... 60/661, 686, 690, 692

[56] References Cited

U.S. PATENT DOCUMENTS

| | | | |
|---|---|---|---|
| 2,108,614 | 2/1938 | Rosch et al. | 60/686 |
| 2,235,541 | 3/1941 | Warren | 60/661 |
| 2,294,350 | 8/1942 | Price | 60/686 |
| 2,994,198 | 8/1961 | Snyder | 60/661 |

*Primary Examiner*—Allen M. Ostrager
*Assistant Examiner*—Stephen F. Husar
*Attorney, Agent, or Firm*—J. W. Keen

[57] ABSTRACT

An apparatus and method for controlling fluid velocity exhausting from an elastic fluid turbine within a predetermined range. Elastic fluid flow rate and velocity is measured through the turbine's exhaust stage and coolant flow rate to heat exchange tubes situated downstream from the exhaust stage is regulated so as to maintain exhaust pressure and, thus, fluid velocity through the exhaust stage within a predetermined range. Pressure measuring devices situated upstream and downstream from the turbine exhaust stage provide flow rate and velocity measurements for the elastic fluid passing thereby while the coolant flow rate through the heat exchange tubes is regulated by a variably restrictive valve or variable speed coolant pump.

6 Claims, 6 Drawing Figures

APPARATUS AND METHOD FOR RESTRICTING TURBINE EXHAUST VELOCITY WITHIN A PREDETERMINED RANGE

BACKGROUND OF THE INVENTION

1. Field of the Invention

This invention relates to elastic fluid turbines and more particularly to means for controlling the velocity of elastic fluid exhausting from such turbine within a predetermined range.

2. Description of the Prior Art

Steam turbines of relatively recent design have steam flow rates per area typically falling within the range of 12,000 pounds per hour per square foot to 18,000 pounds per hour per square foot with steam turbines employing saturated or wet steam having the relatively high flow rates per area of the previously described range. Expanding such enormous quantities of steam in a relatively reasonable number of separate flow paths require large cross-sectional area flows in the turbine's blade ducts with the last or exhaust stage blades of the turbine being correspondingly long. The exhaust stage or last row of blades of a typical large steam turbine converts about 6 percent of the total energy reduction of the steam into mechanical energy. Due to such high quality of energy conversion and large size of the exhaust stage turbine blades, extraordinary emphasis has been placed on the design of those blades.

Obtaining highest possible stage efficiencies and avoiding negative reactions on all turbine blades require axial velocities to be maintained within a specific range. Axial velocity of steam exiting a rotatable turbine blade is one of the most significant parameters for determining stage loading, probability of negative reaction, and probability of a turbine stage doing negative work. Last stage or exhaust blades in a turbine are the most difficult blades to optimally design since they are exposed to widely varying pressure ratios due to part load and overload operations. When exhaust pressures downstream from the exhaust stage vary, last stage blade optimization becomes even more difficult and often results in blades whose peak efficiencies may be rather low. Relatively small variations in exhaust pressure can have a substantial effect on turbine performance. The effect is especially pronounced when the turbine is operating at part load, during startup, or during shutdown where a change in back pressure of less than one inch of mercury for any given mass flow rate can cause the exhaust stage's mode of operation to change from zero work to choked flow or vice versa. The normal operation point for turbines is usually designed to fall between the two aforementioned extremes. Operation in the choked flow region would yield no additional turbine power output, but would increase the heat rate of the cycle whereas operation beyond the zero work region would cause consumption of, rather than production of, work generated by the remainder of the turbine blades. An additional disadvantage to operating beyond the zero work point is that the last stage would eventually experience the stall flutter phenomenon which can cause extraordinarily large blade vibrations. An additional reason for avoiding operation beyond the choke point is the discontinuous flow patterns which result upstream and downstream from the choke point. Such discontinuous and unsteady flow adds vectorially to any stimulating vibratory force on the blade caused by external forces.

Exhaust stage blading in actual service conditions starts choking at selected points along the blades and increases as the blade becomes fully choked. Attempts to provide uniform flow along the last stage turbine blades include extensive effort in providing a diffuser for the turbine's exhaust hood so that steam exiting the turbine's last stage blades at selected points does not "short-circuit" the diffuser and enter the condenser at high velocity.

Since the stall flutter phenomenon and unsteady, discontinuous flow occur beyond the zero work point and choke point respectively, any significant operation of the turbine beyond those points can adversely affect the life of the last stage turbine blades and thus the turbine itself. Precise control of the operating exhaust pressure would be highly desirable since such control would permit last stage turbine blade operation to be relegated to the flow region between the zero work point and choke flow point.

SUMMARY OF THE INVENTION

In accordance with the present invention, an improved power plant system is provided for controlling the exhaust operating pressure of a turbine utilized in that power plant system. The invention generally comprises an elastic fluid turbine which has an exhaust stage in fluid communication with a heat rejection element having coolant circulated through tubes situated therein, means for measuring the flow rate and velocity of elastic fluid flow through the turbine's exhaust stage, and means responsive to such measuring means for controlling coolant flow rate through the heat rejection element's tubes.

In a preferred embodiment of the invention the measuring means constitute a total pressure probe upstream from the exhaust stage and a static pressure probe situated downstream from the exhaust stage with the pressure probes being cooperatively associated so as to provide a signal indicative of the elastic fluid's velocity and flow rate. The controlling means for such preferred embodiment includes a variable speed pump which provides selected coolant flow rates to the heat rejection element tubes. Controlling the coolant flow rate regulates the elastic fluid's exhaust pressure and thus its velocity through the turbine's exhaust stage.

BRIEF DESCRIPTION OF THE DRAWINGS

The invention will be more fully understood from the following detailed description of a preferred embodiment, taken in connection with the accompanying drawings, in which.

DESCRIPTION OF THE PREFERRED EMBODIMENT

The present invention is concerned primarily with controlling the back pressure exerted against the exhaust stage of an elastic fluid turbine within a discrete, optimum range. Accordingly, in the description which follows the invention is shown embodied in a large steam turbine power plant system. It should be understood, however, that the invention may also be utilized in connection with other elastic fluid turbine apparatus.

Figure 1:
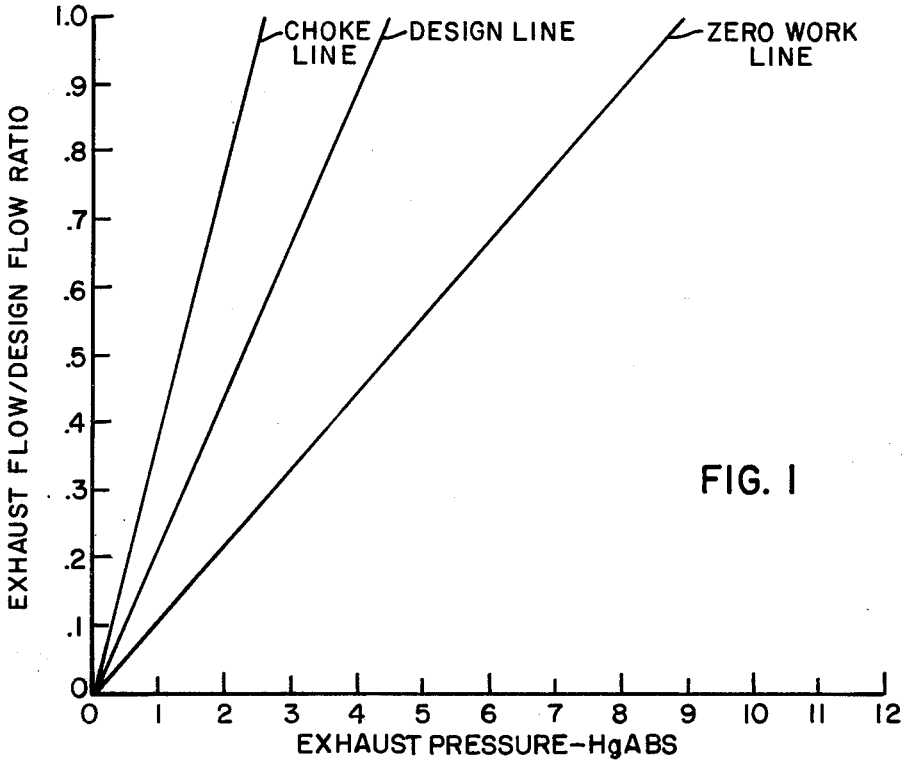
FIG. 1 is a plot of an exemplary steam turbine exhaust stage exhaust flow/design flow ratio versus exhaust pressure with lines of constant Mach number.

FIG. 1 illustrates a plot of exhaust end loading ratio for a typical steam turbine versus the back pressure exerted against the exhaust stage of the steam turbine. Lines of constant Mach number are illustrated for choked operation, design operation, and zero work operation. Operation of the turbine exhaust stage in the area bounded by the choked operation line and the zero work line is highly desirable since operation to the right of zero work line results in consumption of, rather than production of, energy by the turbine and operation to the left of the choke line results in flow discontinuities, promotes blade vibration, results in increased power cycle heat rate. For any particular exhaust flow loading (pounds per hour per square foot) the Mach number can be controlled by regulation of the exhaust pressure.

Figure 2:
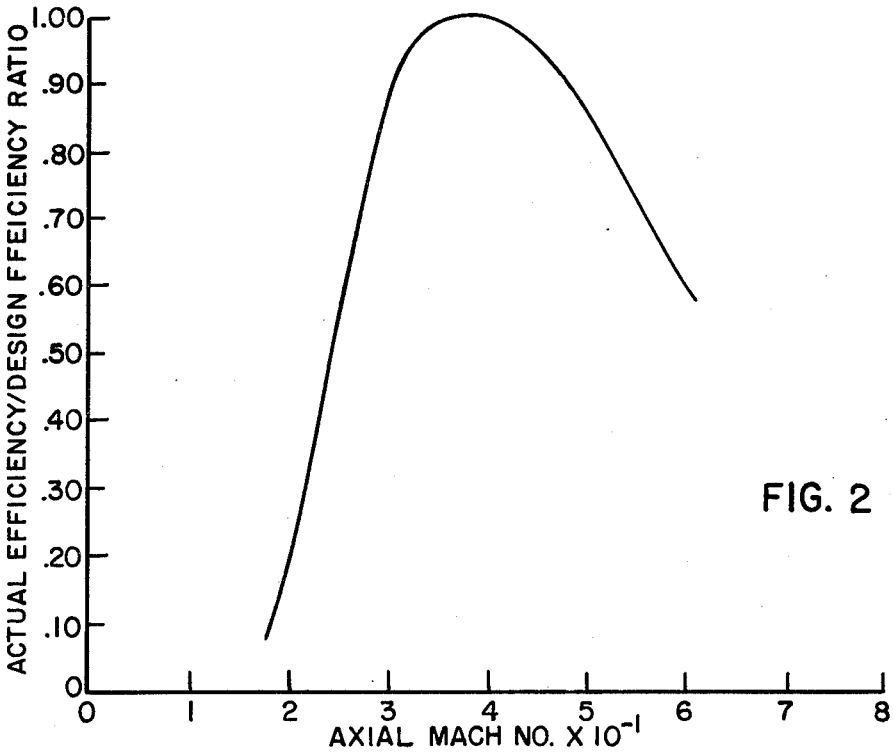
FIG. 2 is a plot of the turbine's exhaust stage efficiency/design efficiency ratio versus the axial Mach number of the elastic fluid passing through the exhaust stage.

FIG. 2 illustrates a typical plot of exhaust stage efficiency ratio versus axial Mach number. It is to be understood that maximum exhaust stage efficiency occurs at variable axial Mach numbers which depend on the particular turbines's characteristics. Additionally, the design exhaust Mach number may be selcted to correspond to any exhaust stage efficiency that is desired.

Figure 3:
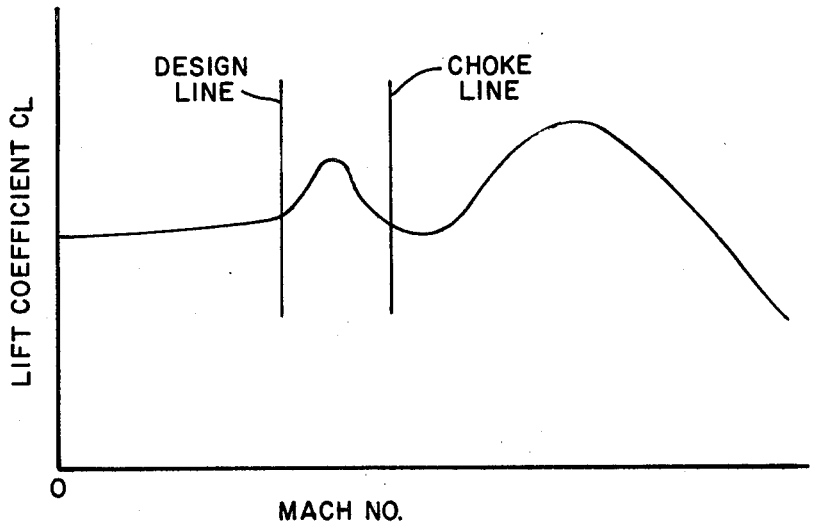
FIG. 3 illustrates a plot of the turbine's exhaust stage lift coefficient versus Mach number.
Figure 4:
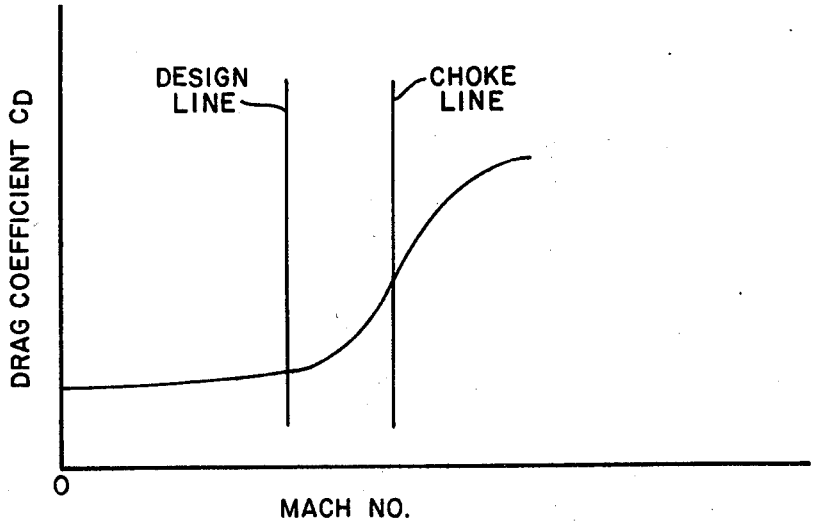
FIG. 4 illustrates a plot of the turbine's exhaust stage drag coefficient versus Mach number.

FIGS. 3 and 4 are plots of lift and drag coefficients respectively versus Mach number for a turbine exhaust stage. Lines designating the hypothetical design operation and choked operation are indicated on each plot. The lift coefficient may be seen to rapidly increase and decrease in passing from the design Mach number to the choke Mach number. Such change in the lift coefficient causes the exhaust stage of the steam turbine to experience transonic vibratory stimulation as the Mach number varies between the design and choke lines. The drag coefficient is seen to remain nearly constant with increasing Mach number until the Mach number surpasses the design line. A rapid increase in the drag coefficient is to be noted as the Mach number increases from the design line to the choke line. Thus, the exhaust stage of the turbine experiences a positive transient vibratory force when the steam passing thereby increases in axial Mach number from the design line to the choke line. Such positive transient vibratory force can adversely affect the life of the exhaust stage blades, rotor disc, and other parts of the steam turbine. Thus, while the lift and drag coefficients in FIGS. 3 and 4 respectively have not been quantified, they are presented to illustrate two factors in addition to the exhaust stage efficiency which affect the selection of the turbine's design point. While the lift and drag coefficient's numerical quantities may change from turbine to turbine, the general shape of the curves, when plotted against axial Mach number, present essentially the same shape.

Figure 5A:
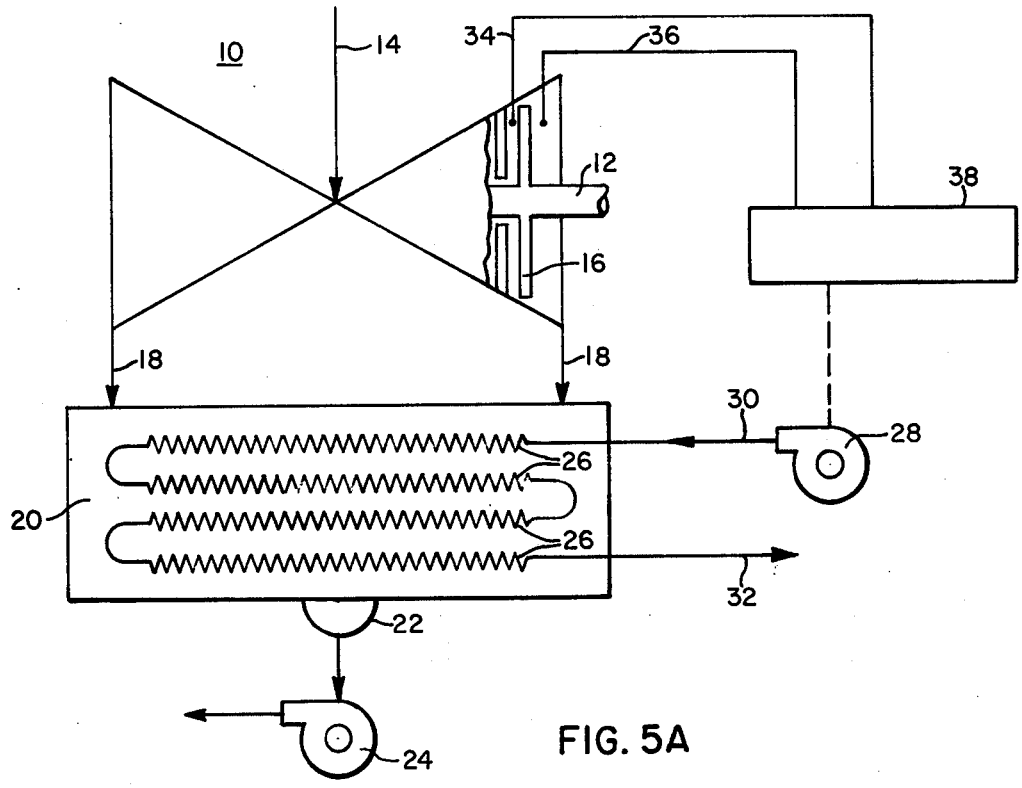
FIGS. 5A and 5B schematically illustrate a variable speed pump supplying coolant to a condenser and a constant speed, variably restrictive valve through which coolant is supplied to the condenser.
Figure 5B:
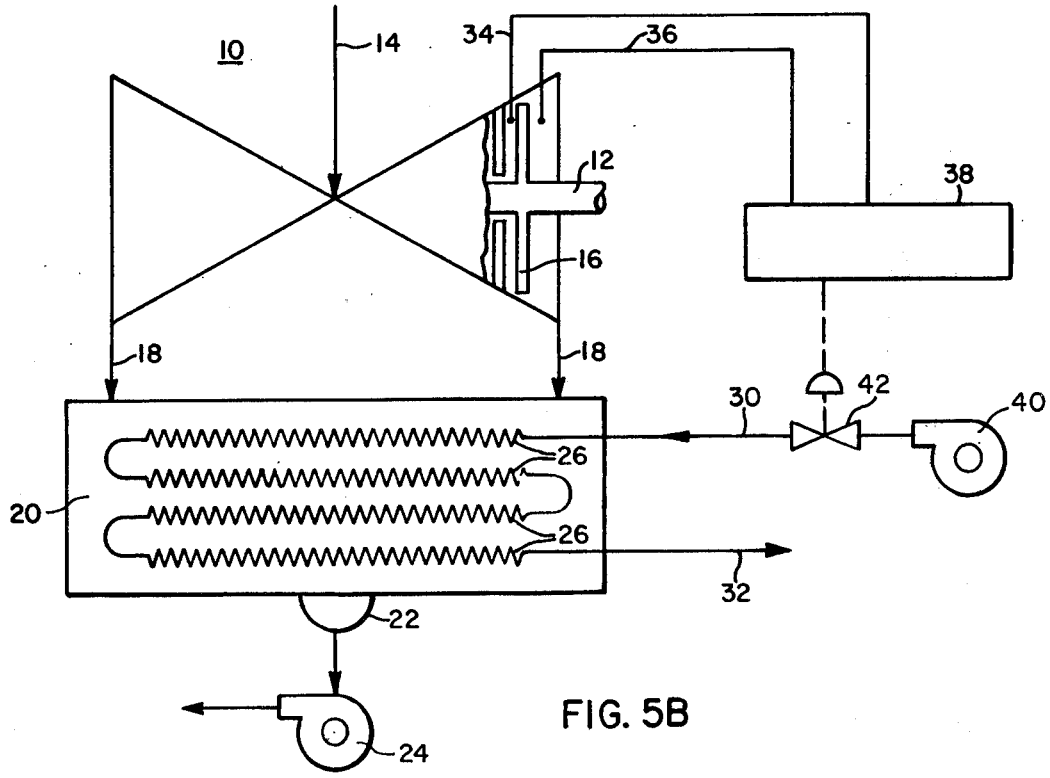

In order to restrain the exhaust stage's flow rate between the zero work line and choke line, the apparatus illustrated in FIGS. 5A and 5B may be used. FIG. 5A illustrates turbine 10 having a rotatable shaft 12 extending therethrough. Steam or other elastic fluid enters turbine 10 along the arrow indicated as 14 and expands through successively lower pressure stages and exits exhaust stage 16 which is attached to rotatable shift 12. Upon exiting exhaust stage 16 the steam flows in the direction of arrows 18 into condenser 20 where the low pressure exhausted steam is condensed, drained into hot well 22, and pumped away therefrom by feedwater pump 24. Condensation of exhaust steam is accomplished by passing it over a series of heat exchange tubes 26 which are situated inside condenser 20. Coolant supplied by coolant pump 28 is circulated through heat exchange tubes 26 absorbing heat from the exhausted, low pressure steam and travelling in a direction schematically illustrated by arrows 30 and 32. Steam flow rate per area through exhaust stage 16 and its velocity are obtained by disposing a total pressure probe 34 upstream and a static pressure probe 36 downstream from exhaust stage 16. Signals from the total pressure probe 34 and static pressure probe 36 are interpreted by controller 38 which transmits signals to variable speed pump 28 to increase or decrease its present coolant flow rate so as to maintain an axial steam Mach number through the turbine's exhaust stage between the zero work line and the choke line. Increasing the coolant flow rate through condenser 20 tends to drive the steam's exhaust stage Mach number toward the choke line while a decrease in the coolant flow rate tends to drive the exhaust stage's axial Mach number toward the zero work line. Thus, exacting exhaust stage velocity control can be maintained for any exhaust end loading from zero to the maximum. Such precise control enables startups and shut-downs having much less blade vibration.

FIG. 5B is the same as FIG. 5A except instead of using variable flow rate pump 28, a constant flow rate pump 40 used in combination with a variably restricted valve 42 whose opening therethrough is precisely controlled by controller 38. Other schemes, such as variably restricted bypass lines around condenser 20 may be utilized to maintain the exhaust stage pressure within the desired limits.

It will now be apparent that an improved turbine power plant system has been provided in which precise control of exhaust back pressure is utilized to maintain exhaust Mach number and pressure within optimum, predetermined ranges where high turbine exhaust stage efficiency and low power cycle heat rates can be obtained. Control of the steam's exhaust pressure and axial Mach number through the exhaust stage can be maintained within the aforementioned ranges by adjusting the coolant flow rate through the heat rejection condenser. Such structure and method of operation provides smooth turbine performance for all turbine loadings.

I claim:

1. A turbine power plant system for controlling the operating pressure range of the turbine's exhaust stage, said system comprising:

an elastic fluid turbine having a plurality of stages including an exhaust stage;

a heat rejection element in fluid communication with said exhaust stage, said heat rejection element including a shell member and a plurality of heat exchange tubes contained therein, said tubes having coolant circulated therethrough for removing heat from the elastic fluid entering said shell;

means for measuring elastic fluid flow rate and velocity through the exhaust stage; and means responsive to said measuring means for controlling coolant flow rate through said heat exchange tubes so as to regulate both the elastic fluid's pressure within said shell and its velocity through the exhaust stage within a predetermined range.

2. The system of claim 1, said measuring means comprising:

a total pressure probe disposed upstream from said exhaust stage, said total pressure probe being exposable to said elastic fluid, and a static pressure probe disposed downstream from said exhaust stage, said static pressure probe being exposable to said elastic fluid, said probes being cooperatively associated so as to provide a signal indicative of the elastic fluid's velocity and flow rate thereby.

3. The system of claim 1, said controlling means comprising:

a pump in fluid communication with said heat exchange tubes, said pump providing a substantially constant coolant flow rate and a valve for variably restricting the coolant flow rate from the pump to the heat exchange tubes.

4. The system of claim 1, said controlling means comprising:

a pump in fluid communication with said heat exchange tubes, said pump providing a variable coolant flow rate to said heat exchange tubes.

5. A method of operating an elastic fluid turbine power plant system for regulating the operating pressure range of the turbine's exhaust stage, said method comprising:

measuring elastic fluid velocity and flow rate through the turbine's exhaust stage and regulating coolant flow rate through heat exchange tubes which are exposable to elastic fluid exhausting from the turbine's exhaust stage, said coolant flow rate being regulated in response to the elastic fluid flow rate and velocity through said exhaust stage so as to maintain the elastic fluid's velocity within a predetermined range.

6. The operating method of claim 5 wherein said predetermined range is bounded by the choked flow and zero work points of the turbine for any flow rate therethrough.

* * * * *